US006334223B1

(12) United States Patent
Pieri

(10) Patent No.: US 6,334,223 B1
(45) Date of Patent: Jan. 1, 2002

(54) PERINEUM CUSHIONING DEVICE

(76) Inventor: John A. Pieri, 60 Charter Oaks #4, Amherst, NY (US) 14228

( * ) Notice: Subject to any disclaimer, the term of this patent is extended or adjusted under 35 U.S.C. 154(b) by 0 days.

(21) Appl. No.: 09/675,537

(22) Filed: Sep. 29, 2000

(51) Int. Cl.[7] ..... A41D 13/00
(52) U.S. Cl. ..... 2/455; 2/403; 602/67
(58) Field of Search ..... 2/400, 403, 466, 2/455; 602/67, 68, 72, 73

(56) References Cited

U.S. PATENT DOCUMENTS 1,989,686 A * 2/1935 Duetsch ..... 602/67
2,266,062 A * 12/1941 Montmarquet ..... 602/70
4,989,594 A * 2/1991 Doherty et al. ..... 602/70
5,249,306 A * 10/1993 Morris ..... 602/72
5,275,592 A * 1/1994 Grizzaffi ..... 2/403
6,139,515 A * 10/2000 Ito ..... 602/67

* cited by examiner

*Primary Examiner*—Gloria M. Hale

(57) ABSTRACT

A perineum cushioning device for protecting the penile artery of a bicyclist. The perineum cushioning device includes a panel, the panel has a front edge, a back edge, a first side edge and a back side edge. A securing means, including a pair of loop members, removably abuts the panel against the perineum of the user.

16 Claims, 2 Drawing Sheets

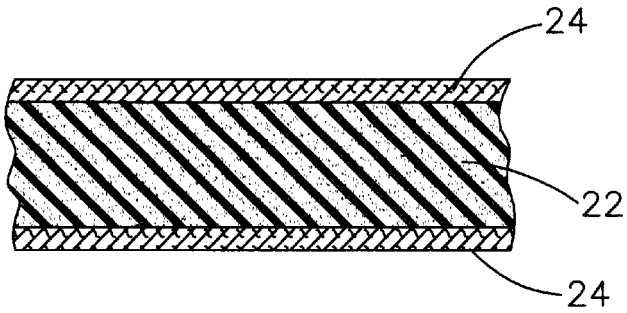
FIG. 3
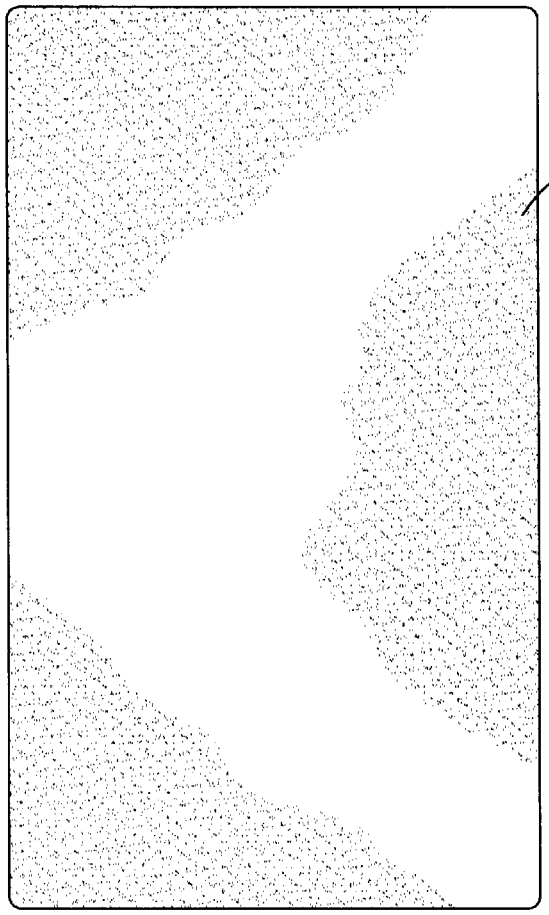
FIG. 4
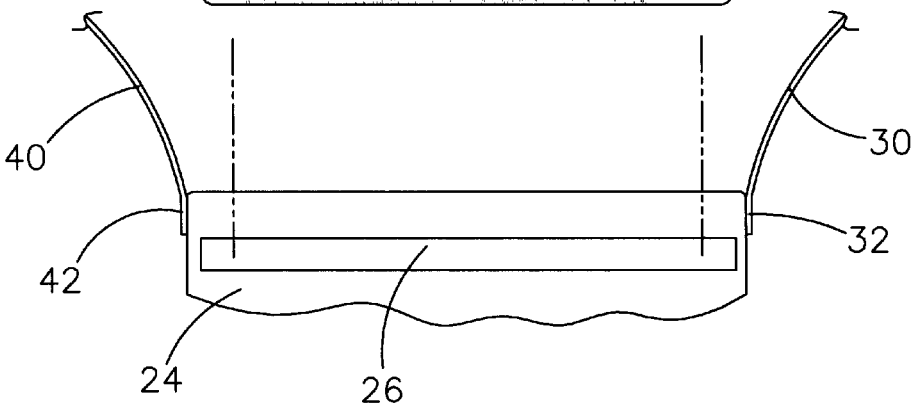

PERINEUM CUSHIONING DEVICE

BACKGROUND OF THE INVENTION

1. Field of the Invention

The present invention relates to cushioning devices and more particularly pertains to a new perineum cushioning device for protecting the penile artery of a bicyclist.

2. Description of the Prior Art

The use of cushioning devices is known in the prior art. More specifically, cushioning devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,229,835; U.S. Pat. No. 2,250,506; U.S. Pat. No. 5,899,895; U.S. Pat. No. 2,401,457; U.S. Pat. No. 4,969,216; and U.S. Des. Pat. No. 395,735.

While these devices fulfill their respective, particular objectives and requirements, the aforementioned patents do not disclose a new perineum cushioning device. The inventive device includes a panel, the panel has a front edge, a back edge, a first side edge and a back side edge. A securing means, including a pair of loop members, removably abuts the panel against the perineum of the user.

In these respects, the perineum cushioning device according to the present invention substantially departs from the conventional concepts and designs of the prior art, and in so doing provides an apparatus primarily developed for the purpose of protecting the penile artery of a bicyclist.

SUMMARY OF THE INVENTION

In view of the foregoing disadvantages inherent in the known types of cushioning devices now present in the prior art, the present invention provides a new perineum cushioning device construction wherein the same can be utilized for protecting the penile artery of a bicyclist.

The general purpose of the present invention, which will be described subsequently in greater detail, is to provide a new perineum cushioning device apparatus and method which has many of the advantages of the cushioning devices mentioned heretofore and many novel features that result in a new perineum cushioning device which is not anticipated, rendered obvious, suggested, or even implied by any of the prior art cushioning devices, either alone or in any combination thereof.

To attain this, the present invention generally comprises a panel, the panel has a front edge, a back edge, a first side edge and a back side edge. A securing means, including a pair of loop members, removably abuts the panel against the perineum of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new perineum cushioning device apparatus and method which has many of the advantages of the cushioning devices mentioned heretofore and many novel features that result in a new perineum cushioning device which is not anticipated, rendered obvious, suggested, or even implied by any of the prior art cushioning devices, either alone or in any combination thereof.

It is another object of the present invention to provide a new perineum cushioning device which may be easily and efficiently manufactured and marketed.

It is a further object of the present invention to provide a new perineum cushioning device which is of a durable and reliable construction.

An even further object of the present invention is to provide a new perineum cushioning device which is susceptible of a low cost of manufacture with regard to both materials and labor, and which accordingly is then susceptible of low prices of sale to the consuming public, thereby making such perineum cushioning device economically available to the buying public.

Still yet another object of the present invention is to provide a new perineum cushioning device which provides in the apparatuses and methods of the prior art some of the advantages thereof, while simultaneously overcoming some of the disadvantages normally associated therewith.

Still another object of the present invention is to provide a new perineum cushioning device for protecting the penile artery of a bicyclist.

Yet another object of the present invention is to provide a new perineum cushioning device which includes a panel, the panel has a front edge, a back edge, a first side edge and a back side edge. A securing means, including a pair of loop members, removably abuts the panel against the perineum of the user.

Still yet another object of the present invention is to provide a new perineum cushioning device that is worn over the perineum of a male bicyclist to protect the penile artery which may be damaged due to extensive bicycle riding and lead to impotency.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic cross-sectional view taken along line 3—3 of the present invention.

FIG. 4 is a schematic top view of the present invention.

DESCRIPTION OF THE PREFERRED EMBODIMENT

Figure 1:
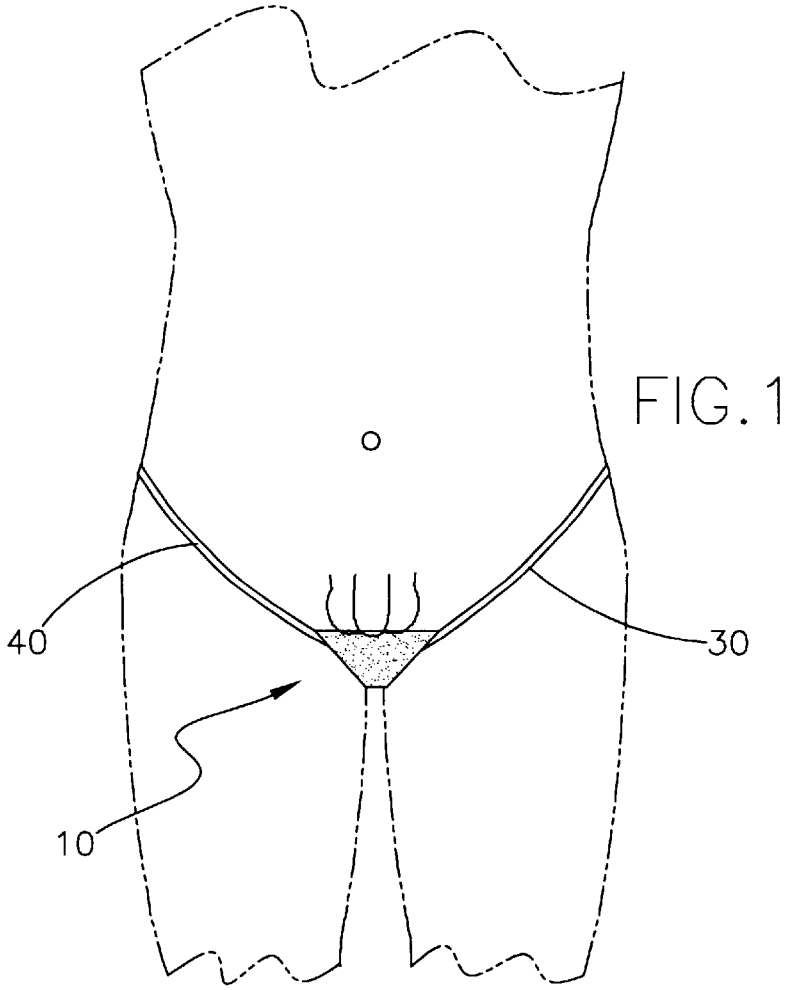
FIG. 1 is a schematic front view of a new perineum cushioning device according to the present invention.
Figure 2:
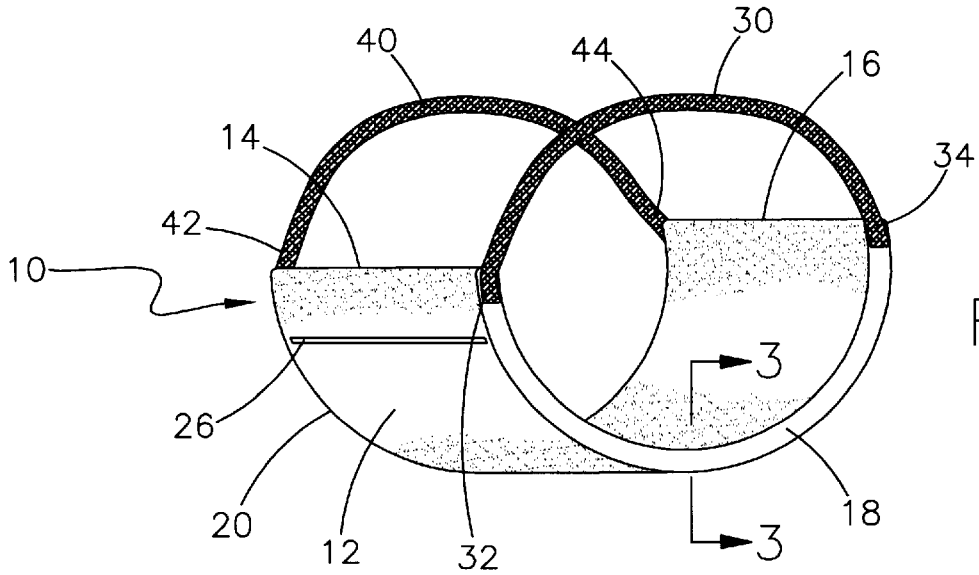
FIG. 2 is a schematic perspective view of the present invention.

With reference now to the drawings, and in particular to FIGS. 1 through 4 thereof, a new perineum cushioning device embodying the principles and concepts of the present invention and generally designated by the reference numeral 10 will be described.

As best illustrated in FIGS. 1 through 4, the perineum cushioning device 10 generally comprises a panel 12. The panel 12 has a front edge 14, a back edge 16, a first side edge 18 and a back side edge 20. The panel 12 has a middle portion 22. The middle portion comprises a cushioning material. The cushioning material is ideally a foamed elastomeric material. The middle portion is generally enclosed in a covering membrane 24. The covering member 24 has a slit 26 extending therethrough. The slit is generally positioned adjacent to the front edge 14 of the panel 12 and orientated generally parallel to the front edge 14. The middle portion 22 may be selectively extended through the slit 26 and be removed from the covering membrane 24. The covering membrane 24 preferably comprises a cloth material. The panel 12 ideally has a width generally between 1 ½ inches and 3 inches, a length generally between 3 inches and 5 inches and a height generally between 1 inch and 2 inches.

A securing means removably abuts the panel against a perineum of a user. The securing means includes a first loop member 30 and a second loop member 40.

The first loop member 30 has a first end 32 and a second end 34. The first end 32 is securely attached to the first side edge 18 and positioned generally adjacent to the front edge 14. The second end 34 is securely attached to the first side edge 18 and positioned generally adjacent to the back edge 16.

The second loop member 40 has a first end 42 and a second end 44. The first end 42 is securely attached to the second side edge 20 and positioned generally adjacent to the front edge 14. The second end 44 is securely attached to the second side edge 20 and positioned generally adjacent to the back edge 16.

Each of the first 30 and second 40 loop members comprises an elongate flexible member. The elongate flexible members are ideally made from an elastomeric material.

In use, the legs of the user are each placed in one of the loop members so that the panel is abutted against the perineum of the wearer. The user then sits on a bicycle seat in a conventional manner so that the panel is positioned between the perineum and the bicycle seat.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A perineum protecting device for protecting the perineum of males while riding a bicycle to prevent damage to the penile artery, said device comprising:

a panel, said panel having a front edge, a back edge, a first side edge and a back side edge; and a securing means for removably abutting said panel against the perineum; said securing means comprising:

a first loop member, said first loop member having a first end and a second end, said first end being securely attached to said first side edge and positioned generally adjacent to said front edge, said second end being securely attached to said first side edge and positioned generally adjacent to said back edge; and a second loop member, said second loop member having a first end and a second end, said first end being securely attached to said second side edge and positioned generally adjacent to said front edge, said second end being securely attached to said second side edge and positioned generally adjacent to said back edge.

2. The perineum protecting device as in claim 1, wherein said panel has a middle portion, said middle portion comprising a cushioning material.

3. The perineum protecting device as in claim 1, wherein said panel has a height generally between 1 inch and 2 inches.

4. The perineum protecting device as in claim 2, wherein said cushioning material comprises a foamed elastomeric material.

5. The perineum protecting device as in claim 2, wherein said middle portion of said panel is generally enclosed in a covering membrane.

6. The perineum protecting device as in claim 5, wherein said covering member of said panel has a slit extending therethrough, wherein said middle portion may be selectively extended through said slit and be removed from said covering membrane.

7. The perineum protecting device as in claim 5, wherein said covering membrane comprises a cloth material, said panel having a width generally between 1½ inches and 3 inches, a length generally between 3 inches and 5 inches and a height generally between 1 inch and 2 inches.

8. The perineum protecting device as in claim 1, wherein each of said first and second loop members comprises an elongate flexible member, said elongate flexible member comprising an elastomeric material.

9. A perineum protecting device for protecting the perineum of males while riding a bicycle to prevent damage to the penile artery, said device comprising:

a panel, said panel having a front edge, a back edge, a first side edge and a back side edge, said panel having a middle portion, said middle portion comprising a cushioning material, said cushioning material comprising a foamed elastomeric material, said middle portion being generally enclosed in a covering membrane, said covering member having a slit extending therethrough, said slit being generally positioned adjacent to said front edge of said panel and orientated generally parallel to said front edge, wherein said middle portion may be selectively extended through said slit and be removed from said covering membrane, said covering membrane comprising a cloth material, said panel having a width generally between 1½ inches and 3 inches, a length generally between 3 inches and 5 inches and a height generally between 1 inch and 2 inches;

a securing means for removably abutting said panel against the perineum, said securing means comprising;

a first loop member, said first loop member having a first end and a second end, said first end being securely attached to said first side edge and positioned generally adjacent to said front edge, said second end being securely attached to said first side edge and positioned generally adjacent to said back edge;

a second loop member, said second loop member having a first end and a second end, said first end being securely attached to said second side edge and positioned generally adjacent to said front edge, said second end being securely attached to said second side edge and positioned generally adjacent to said back edge; and each of said first and second loop members comprising an elongate flexible member, said elongate flexible member comprising an elastomeric material.

10. A perineum protecting device for protecting the perineum of males while riding a bicycle to prevent damage to the penile artery, said device comprising:

a panel having a front edge, a back edge, a first side edge and a back side edge; and a securing means for removably holding said panel against the perineum; said securing means comprising:

a first loop member having a first end and a second end, said first end being attached to said first side edge and positioned generally adjacent to said front edge, said second end being attached to said first side edge and positioned generally adjacent to said back edge; and a second loop member having a first end and a second end, said first end being attached to said second side edge and positioned generally adjacent to said front edge, said second end being attached to said second side edge and positioned generally adjacent to said back edge.

11. The perineum protecting device as in claim 10, wherein said panel has a middle portion comprising a cushioning material.

12. The perineum protecting device as in claim 10, wherein said panel has a height generally between 1 inch and 2 inches.

13. The perineum protecting device as in claim 10, wherein said cushioning material comprises a foamed elastomeric material.

14. The perineum protecting device as in claim 11, wherein said middle portion of said panel is generally enclosed in a covering membrane.

15. The perineum protecting device as in claim 14, wherein said covering member of said panel has a slit extending therethrough, and wherein said middle portion may be selectively extended through said slit and be removed from said covering membrane.

16. The perineum protecting device as in claim 10, wherein each of said first and second loop members comprises an elongate flexible member, said elongate flexible member comprising an elastomeric material.

* * * * *